US006149025A

United States Patent [19]

Wang

[11] Patent Number: 6,149,025

[45] Date of Patent: Nov. 21, 2000

[54] FOLDING COLLAPSIBLE STORAGE BOX

[76] Inventor: Wen-Tsan Wang, P.O. Box 82-144, Taipei, Taiwan

[21] Appl. No.: 09/342,261

[22] Filed: Jun. 29, 1999

[51] Int. Cl.[7] ..... B65D 30/06

[52] U.S. Cl. ..... 220/6; 220/9.3; 220/9.4

[58] Field of Search ..... 220/6, 9.2, 9.3, 220/9.4

[56] References Cited

U.S. PATENT DOCUMENTS

| | | | |
|---|---|---|---|
| 716,231 | 12/1902 | Hoffmann | 220/9.2 |
| 2,030,204 | 2/1936 | Gray | 220/9.2 |
| 2,315,001 | 3/1943 | Logan | 220/9.2 |
| 2,778,560 | 1/1957 | Pfeiffer | 220/9.2 |
| 4,585,159 | 4/1986 | Travis | 220/9.3 |
| 5,009,189 | 4/1991 | Neff | 220/9.2 |
| 5,664,886 | 9/1997 | Hutchinson | 220/9.2 |
| 5,964,533 | 10/1999 | Ziglar | 220/9.3 |

*Primary Examiner*—Joseph M. Moy
*Attorney, Agent, or Firm*—A & J

[57] ABSTRACT

A folding collapsible storage box, which includes a collapsible rectangular cloth box body, four horizontal top rod members respectively horizontally embedded in the four peripheral side walls of the box body at the top, two horizontal rod members embedded in two opposite peripheral side walls of the box body at the bottom, and four vertical rod members respectively embedded in the box body and vertically arranged in between each two adjacent peripheral side walls of the box body, the vertical rod members having respective ends respectively spaced from respective ends of the horizontal top rod members and horizontal bottom rod members at a distance for enabling the folding collapsible storage box to be collapsed by twisting one corner of the box body.

1 Claim, 4 Drawing Sheets

FOLDING COLLAPSIBLE STORAGE BOX

BACKGROUND OF THE INVENTION

The present invention relates to a folding collapsible storage box, and more particularly to such a folding collapsible storage box that is strong when stretched up and, that can be conveniently collapsed by twisting its one corner.

Regualar storage boxes, either made of plastics, wood, or metal, are commonly not collapsible. These storage boxes occupy same storage space when not in use. Further, because these storage boxes not collapsible, the transportation of these storage boxes is inconvenient. There are also known certain storage boxes that can be collapsed into a flat manner when not in use. However, it is complicated to set up these collaposible storage boxes into the operative condition, or to arrange these collapsible storage boxes into a collapsed condition.

SUMMARY OF THE INVENTION

The present invention has been accomplished to provide a folding collapsible storage box, which eliminates the aforesaid problems. According to one aspect of the present invention, the folding collapsible storage box is comprised of a collapsible rectangular box body, four horizontal top rod members respectively horizontally embedded in the four peripheral side walls of the box body at the top, two horizontal rod members embedded in two opposite peripheral side walls of the box body at the bottom, and four vertical rod members respectively embedded in the box body and vertically arranged in between each two adjacent peripheral side walls of the box body, the vertical rod members having respective ends respectively spaced from respective ends of the horizontal top rod members and horizontal bottom rod members at a distance for enabling the folding collapsible storage box to be collapsed by twisting one corner of the box body. According to another aspect of the present invention, the box body is made of strong cloth, for example, canvas. According to still another aspect of the present invention, four sets of hard triangle boards respectively fastened to the four peripheral side walls of the box body to reinforce the structural strength of the box body, each set of hard triangle boards including four hard triangle boards fastened to one peripheral side wall of the box body and separated from one another by the respective crossed diagonal folding lines.

DETAILED DESCRIPTION OF THE PREFERRED EMBODIMENT

Figure 1:
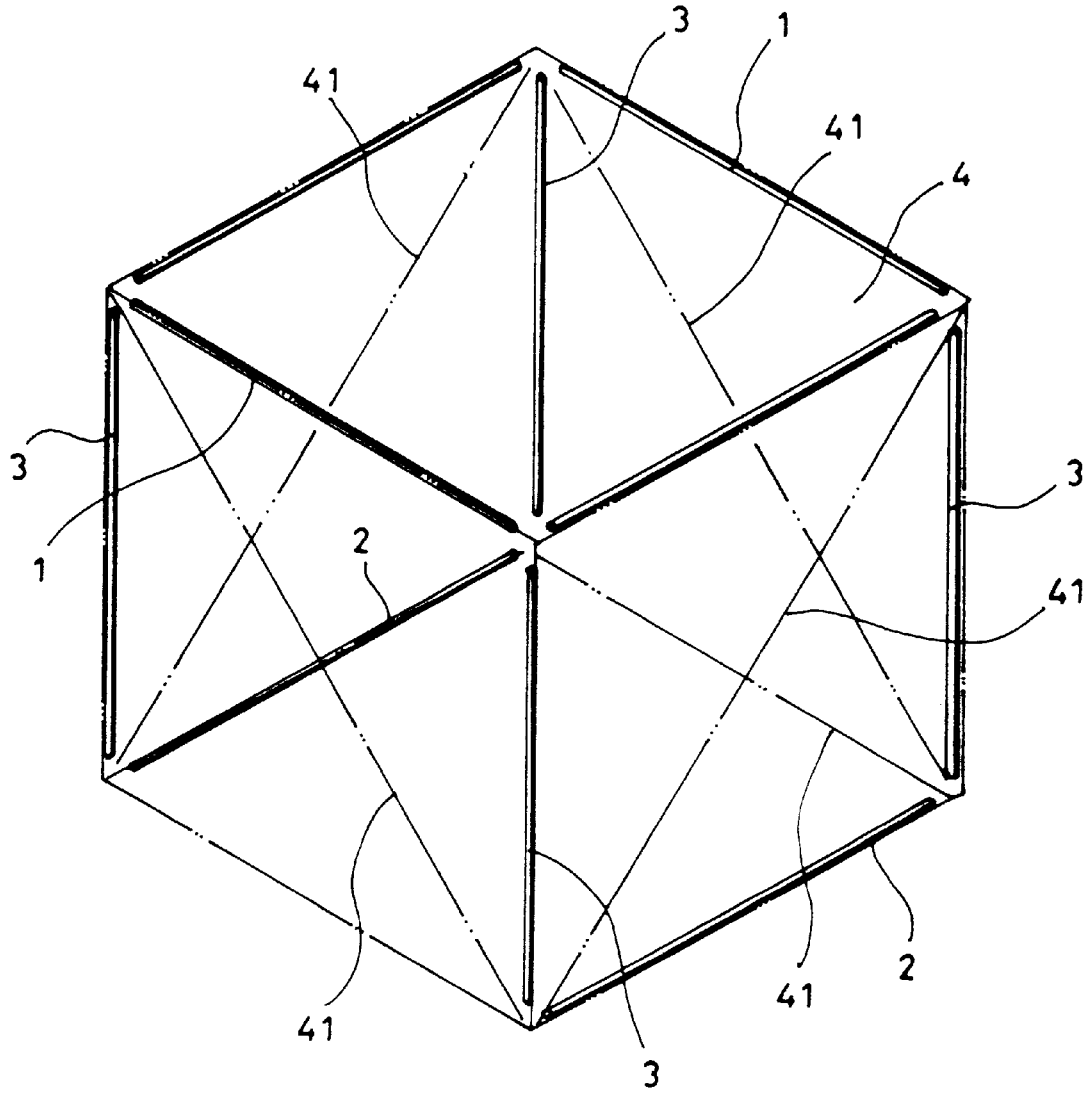
FIG. 1 is a perspective view of a folding collapsible storage box according to the present invention.

Referring to FIG. 1, a folding collapsible storage box in accordance with the present invention is generally comprised of a collapsible box body 4, four horizontal top rod members 1, two horizontal bottom rod members 2, and four vertical rod members 3. The box body 4 is made of strong coarse cloth, for example, canvas, having a bottom wall and four peripheral side walls and a top opening. Two crossed diagonal folding lines 41 are provided at each of the four peripheral side walls of the box body 4. The horizontal top rod members 1 and the horizontal bottom rod members 2 are equal in length, and shorter than the horizontal length of the peripheral side walls of the box body 4. The four horizontal top rod members 1 are respectively horizontally embedded in the canvas of the box body 4 and disposed along the top side of each of the four peripheral side walls of the box body 4, permitting a gap to be left between each two adjacent horizontal top rod members 1. The two horizontal rod members 2 are embedded in the canvas of the box body 4 and disposed along the bottom side of each of two opposite peripheral side walls of the box body 4. The four vertical rod members 3 are respectively embedded in the canvas of the box body 4, and vertically arranged in between each two adjacent peripheral side walls of the box body 4. After installation of the rod members 1, 2 and 3, the top and bottom ends of each of the vertical rod members 3 are respectively spaced from the horizontal top rod members 1 and the horizontal bottom rod members 2 at a distance.

Figure 2:
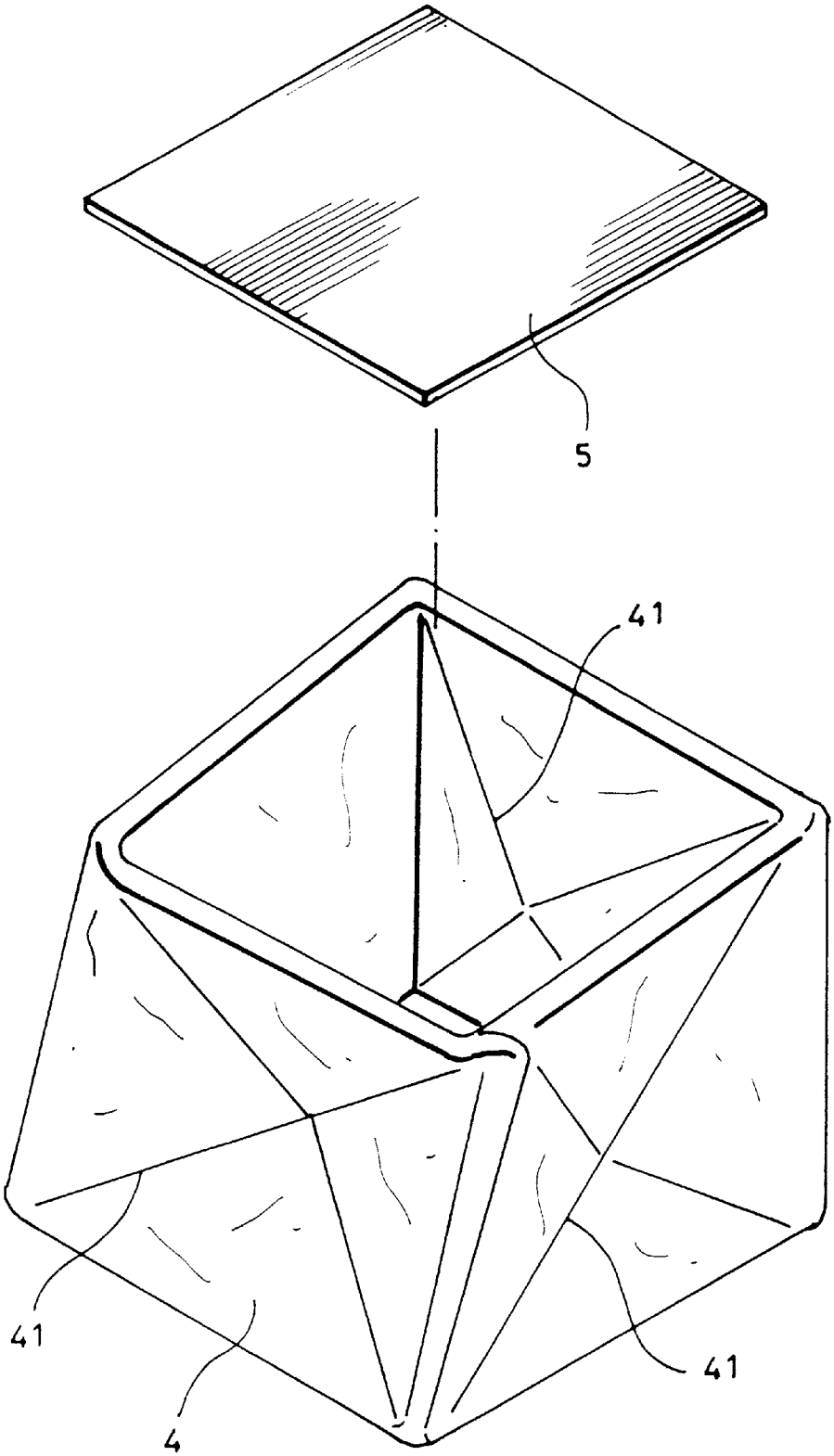
FIG. 2 illustrates one corner of the folding collapsible storage box twisted.

Referring to FIG. 2 and FIG. 1 again, when the box body 4 is stretched up, the folding collapsible storage box is supported by the rod members 1, 2 and 3 into shape, and a hard bottom board 5 is put into the inside of the box body 4 to support storage items in the folding collapsible storage box.

Figure 3:
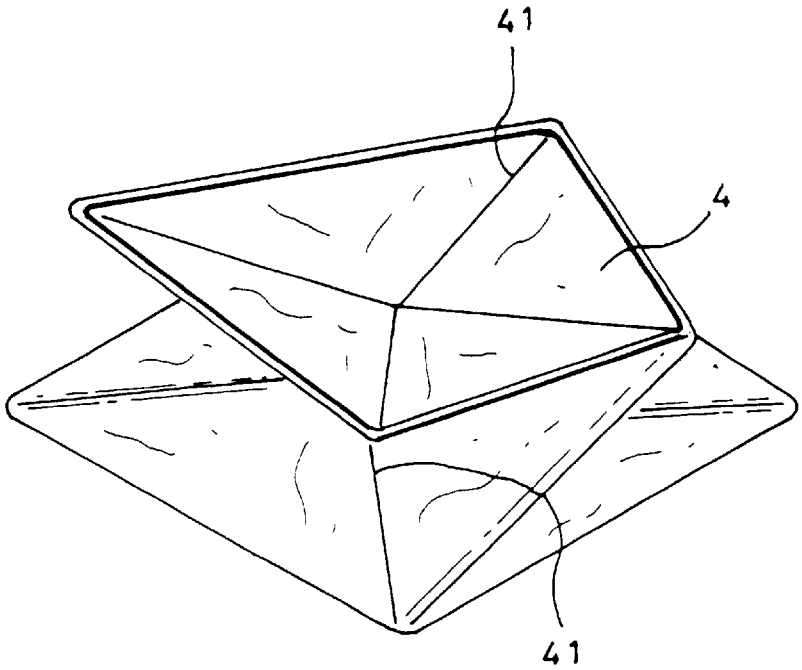
FIG. 3 illustrates the folding collapsible storage box twisted and lowered down.
Figure 4:
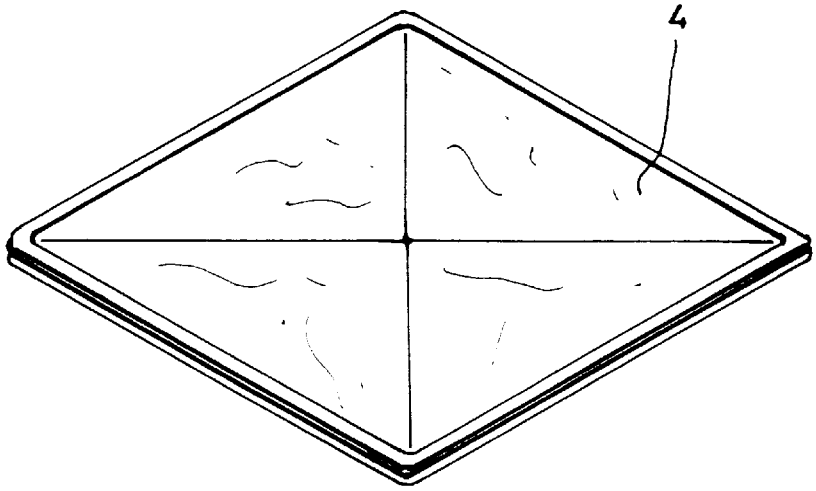
FIG. 4 illustrates the folding collapsible storage box collapsed.

Referring to FIGS. 3 and 4, when not in use, the hard bottom board 5 is taken away from the box body 4, then one corner of the box body 4 is twisted to tile the respective vertical rod member 3 (see FIG. 2), and the folding collapsible storage box is collapsed into a flat manner when continuously twisting the corner of the box body 4 (see FIGS. 3 and 4).

Figure 5:
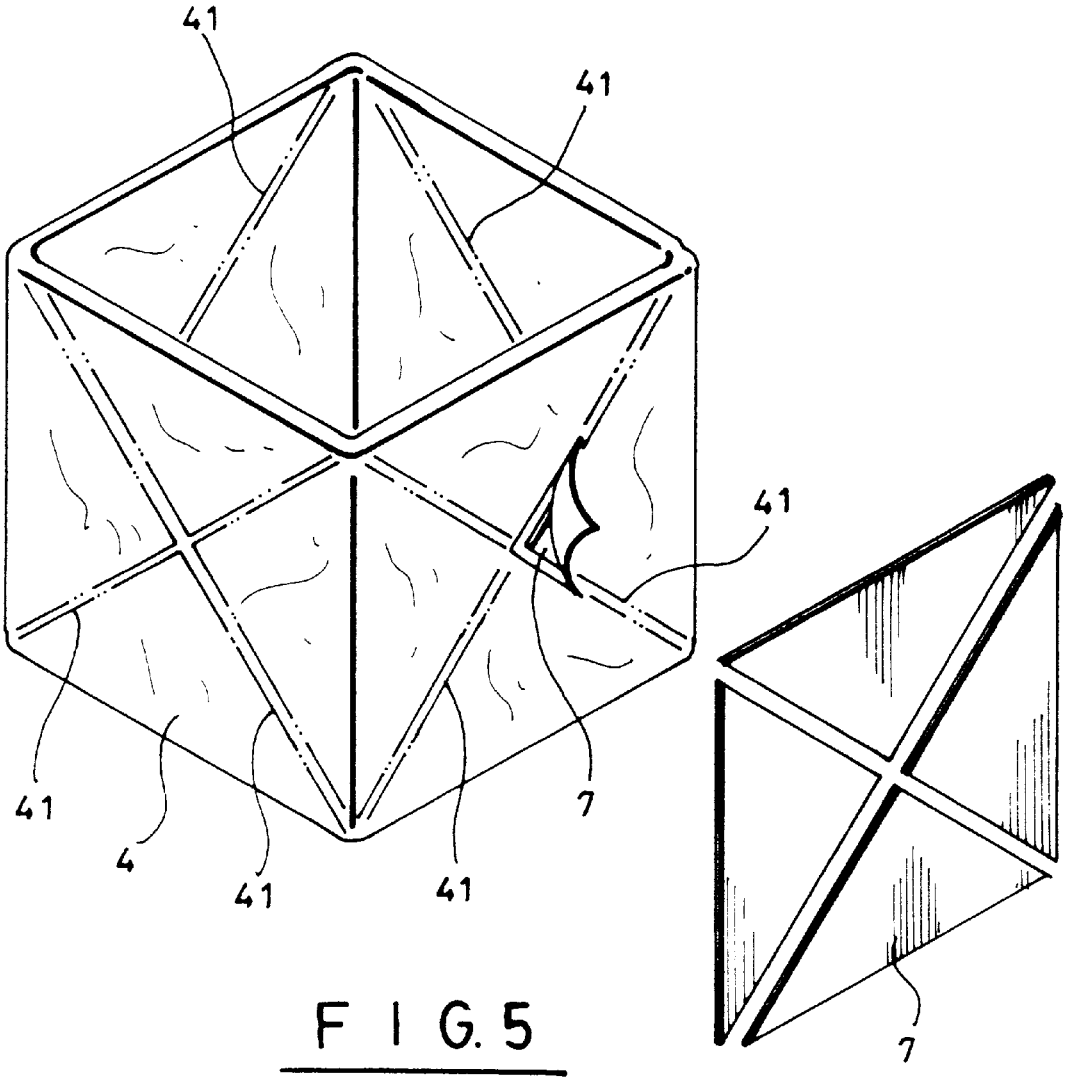
FIG. 5 illustrates an alternate form of the present invention.

FIG. 5 shows an alternate form of the present invention. According to this alternate form, four hard triangle plates 7 are arranged at each of the four peripheral side walls of the box body 4, and separated from one another by the respective crossed diagonal folding lines 41. The hard triangle plates 7 reinforce the structural strength of the peripheral side walls of the box body 4, and allow the box body 4 to be twisted into a collapsed manner.

It is to be understood that the drawings are designed for purposes of illustration only, and are not intended for use as a definition of the limits and scope of the invention disclosed. For example, handle means may be provided at the peripheral side walls of the box body 4 for the holding of the hands.

What is claimed is:

1. A folding collapsible storage box comprising:

a collapsible cloth box body, said box body having a bottom wall and four peripheral said walls and a top opening, said four peripheral side walls each having two crossed diagonal folding lines;

four horizontal top rod members respectively horizontally embedded in said four peripheral side walls of said box body at a top side, said horizontal top rod members having respective ends spaced from one another at a distance;

two horizontal bottom rod members embedded in two opposite peripheral side walls of said box body at a bottom side;

four vertical rod members respectively embedded in said box body and vertically arranged in between each two adjacent peripheral side walls of said box body, said vertical rod members having respective ends respectively spaced from the respective ends of said horizontal top rod members and said horizontal bottom rod members at a distance; and four sets of hard triangle boards respectively fastened to the four peripheral side walls of said box body, each set of hard triangle boards including four hard triangle boards fastened to one peripheral side wall of said box body and separated from one another by the respective crossed diagonal folding lines.

* * * * *